United States Patent [19]

Gunn

[11] 4,384,503

[45] May 24, 1983

[54] MULITIPLE LANGUAGE ELECTRONIC MUSICAL KEYBOARD SYSTEM

[75] Inventor: Gary Gunn, Berkeley, Calif.

[73] Assignee: Pied Piper Enterprises, Inc., San Francisco, Calif.

[21] Appl. No.: 266,436

[22] Filed: May 22, 1981

[51] Int. Cl.[3] ..... G10H 1/00

[52] U.S. Cl. ..... 84/1.01; 84/1.16; 84/1.24; 84/DIG. 30

[58] Field of Search ..... 84/1.01, 1.24, 478, 84/477 R, 1.03, DIG. 30, 1.16, 1.19, 1.26

[56] References Cited

U.S. PATENT DOCUMENTS

| | | | |
|---|---|---|---|
| 3,821,458 | 6/1974 | Schreier | 84/1.26 |
| 3,881,390 | 5/1975 | Gullickson | 84/478 |
| 3,886,836 | 6/1975 | Hiyoshi | 84/1.19 |
| 4,080,867 | 3/1978 | Ratanangsu | 84/478 |
| 4,133,244 | 1/1979 | Hiyoshi et al. | 84/1.24 |
| 4,257,306 | 3/1981 | Laflamme | 340/365 S |
| 4,295,406 | 10/1981 | Smith | 84/478 |
| 4,318,327 | 3/1982 | Toups | 84/477 R |
| 4,321,852 | 3/1982 | Young, Jr. | 84/DIG. 30 |
| 4,344,069 | 8/1982 | Prame | 340/365 S |

OTHER PUBLICATIONS

Holdsworth et al., "Logic Design-2", Wireless World, Feb. 1977, pp. 49-53.

1981 IC Master, p. 873, Signetics Programmable Keyboard and Communications Controller.

*Primary Examiner*—J. V. Truhe

*Assistant Examiner*—Forester W. Isen

*Attorney, Agent, or Firm*—Manfred M. Warren; Robert B. Chickering; Glen R. Grunewald

[57] ABSTRACT

A multiple language electronic keyboard system is disclosed for generating and modifying musical note information. The system includes a plurality of manually activated switches arranged in a matrix of rows and columns with the switches sufficiently close to allow a single finger of the user to activate a plurality of switches in a single stroke. A decoder detects and distinguishes between a first language and a second language of distinct switch activation patterns. Musical note information is generated by a processor which receives information from the decoder concerning the location of each activated switch and the language detected by the decoder. The versatility of this system is further enhanced by the addition of envelope and tone generators and also by visual display devices. In the preferred embodiment the keyboard is arranged to positionally and operationally emulate a guitar fret board.

14 Claims, 3 Drawing Figures

MULITIPLE LANGUAGE ELECTRONIC MUSICAL KEYBOARD SYSTEM

BACKGROUND OF THE INVENTION

1. Field of Invention

This invention relates generally to electronic musical synthesizers and more particularly keyboard control systems for generating and modififying musical note information.

2. Description of Prior Art

The development of microprocessors has opened up new vistas in a number of diverse fields. In the area of musical instruments, however, the changes brought about by microprocessors are not nearly so profound as one might expect. The microprocessor has found use in connection with piano-type keyboard synthesizers and also in connection with special purpose electronic musical instruments which are unlike traditional musical instruments. The microprocessor's great ability to store, manipulate and control information has not been successfully applied to traditional musical instruments. Horns, woodwinds, and the traditional stringed instruments have a long and rich heritage. These instruments have existed for thousands of years and the methods of playing these instruments have remained essentially unchanged.

Virtuosos have continually pushed the limits imposed by human physiology and the physical inertia of their traditional instruments in an effort to increase the speed and complexity of the music which they produce. Beginners and experts generally play instruments (e.g. guitars) which differ only in quality and not in basic configuration. This allows complete unhindered transference of skills when one gains experience and switches to a better instrument. Microprocessor-based instruments which can be played with the same fingering as the traditional instruments which they emulate offer a great appeal to those who have already had some experience with traditional instruments and do not wish to discard their skills or learn new ones in order to play a microprocessor-based instruments.

What is needed in order to take full advantage of the benefits of microprocessors in connection with traditional-type musical instruments is an input device which is similar in physical configuration to the finger-operated portions of the traditional instruments. Mere physical similarity, however, is not enough to fully realize the benefits. Additionally, the microprocessor-based instrument must be able to respond to traditional fingerings and produce the sounds and notes normally associated with these fingerings on traditional instruments. This still is not enough since it would offer very little advantage to the virtuoso. What is further needed is an input device which will respond normally to traditional fingerings and which is also capable of recognizing a second "short-hand" language of largely non-traditional fingerings which can be utilized by the virtuoso to produce a variety of effects, sequences, sounds, etc. which could not be similarly produced in a traditional instrument without great or impossible difficulty.

When music is examined in a theoretical perspective, it is seen to be essentially mathematical in nature, thus making it especially well suited for microprocessors. A microprocess-based instrument which responds identically to a traditional instrument given the same traditional fingerings yet is capable of greatly enhanced performance when given special "short-hand" commands would benefit both the beginner and expert alike. Such an instrument, especially when coupled with special video display devices for real-time feedback of musical note information, would greatly accelerate learning. Skills acquired in the use of this instrument would be easily transferable to traditional instruments and vice versa.

Prior art devices have provided interesting and valuable improvements in the state-of-the-art, but none has satisfied all of the foregoing needs due to the fact that none of the prior art devices could distinguish between the traditional "long-hand" language of traditional fingerings and a second "short-hand" language. Prior art devices which used a traditionally configured keyboard for long-hand traditional fingering and a separate keyboard for complex functions such as automatic chord generation did not offer nearly the same benefits of a single traditionally configured keyboard which could accept and distinguish between both long-hand and short-hand fingerings.

SUMMARY OF THE INVENTION

This invention provides a multiple language electronic keyboard system for generating and modifying musical note information. An object of the invention is to provide a new musical instrument which can be played using pre-existing traditional instrument playing skills and which requires no additional training for initial use since traditional fingerings will produce traditional results.

Another object of the invention is to provide a second level of operability which allows highly complex music-making without requiring extraordinary dexterity.

The instant invention allows those handicapped by lack of education, talent, motor dexterity, or physical ability to learn and play music more easily than these people could if using traditional instruments.

A still further object of this invention is to facilitate the learning of music playing through audio-visual feedback of the musical note information as well as sounds to the user.

This invention provides a simple "short-hand" means of producing chords and includes means for teaching the traditional "long-hand" means of producing the same chord and further is capable of displaying, visually, the musical makeup of the chord.

A still further object of the instant invention is to provide a multiple-language keyboard which allows multiple and distinct methods of producing chords and which allows the various languages to be used at any time without requiring anything more than fingering the proper pattern of switches.

The keyboard of the instant invention can be viewed as a microterminal adapted for use by an instrument player for communicating musical information to a processor which then can manipulate and implement the information in real time.

A still further object of the instant invention is to provide a synthesized guitar-like instrument capable of greatly enhanced performance in comparison to a traditional guitar.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and descriptions may be adopted within the scope of the invention as set forth in the claims.

DETAILED DESCRIPTION OF THE INVENTION

Figure 1:
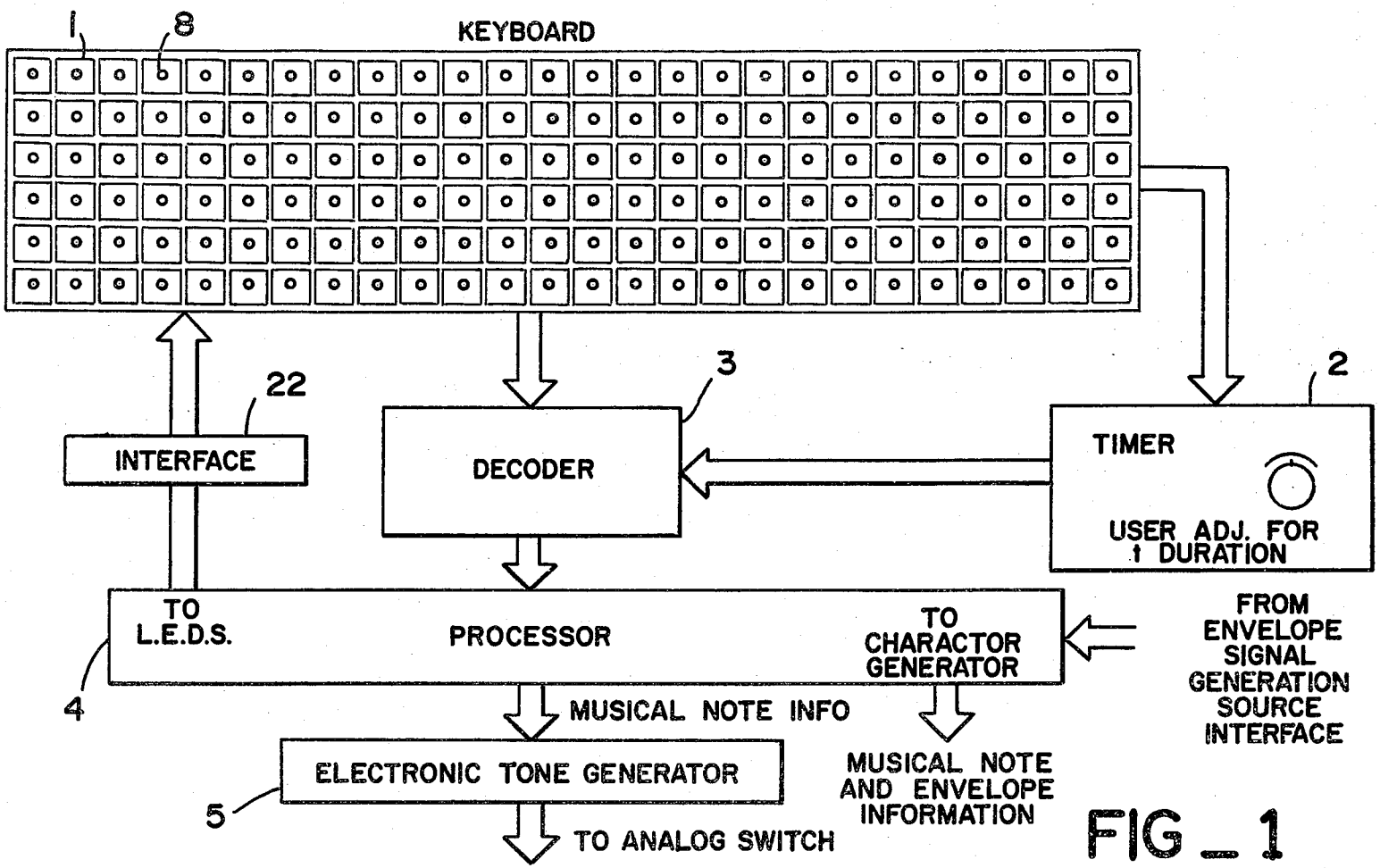
FIG. 1 is a block diagram of a portion of the keyboard system.
Figure 2:
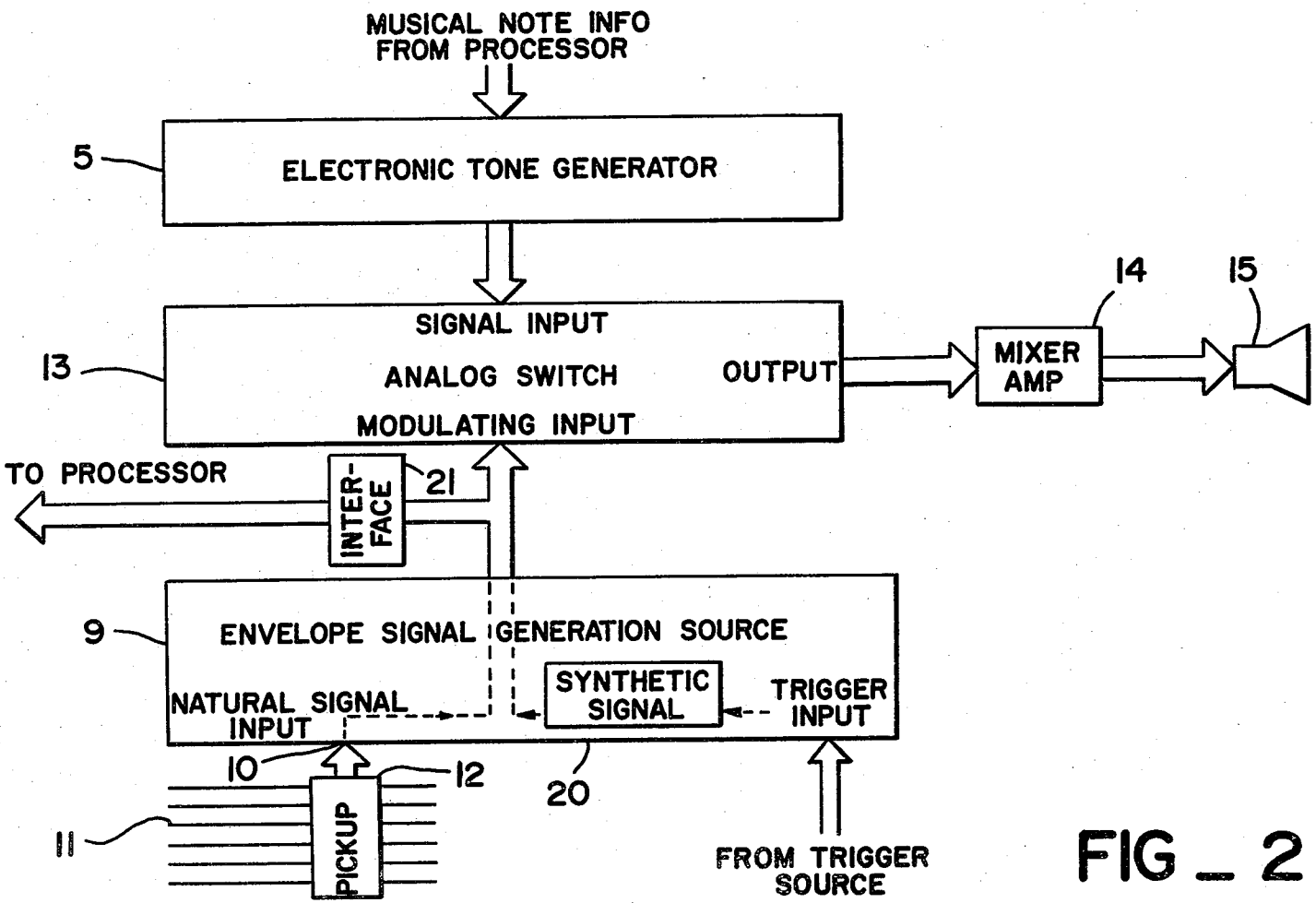
FIG. 2 is a block diagram of a portion of the keyboard system.
Figure 3:
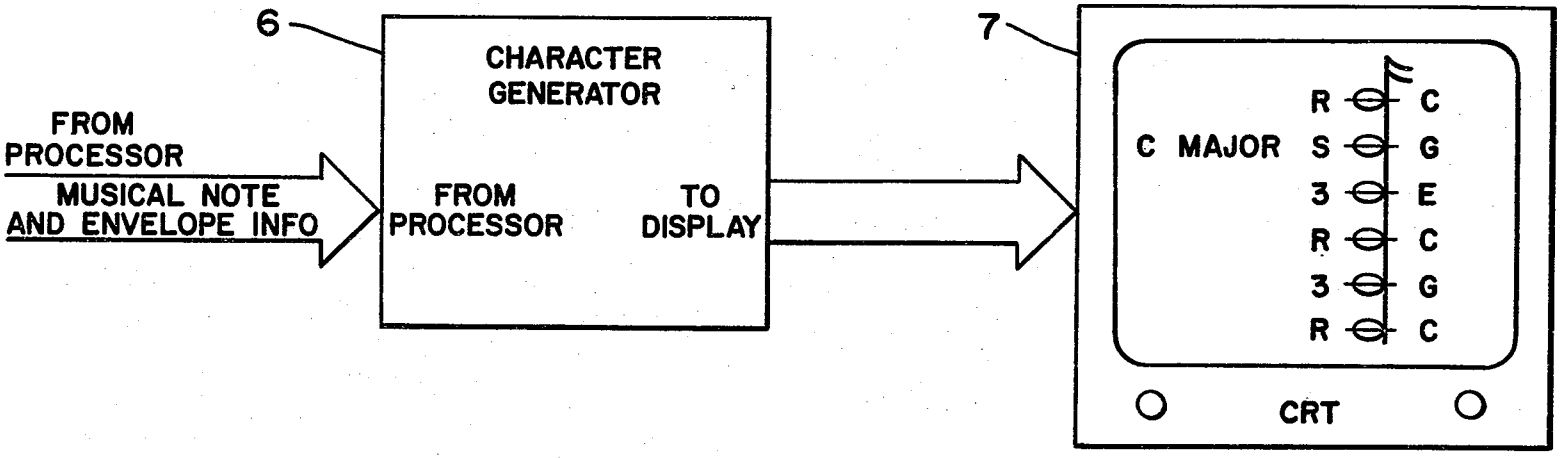
FIG. 3 is a block diagram of a portion of the keyboard system.

The multiple-language electronic musical keyboard system of the instant invention comprises briefly a plurality of manually activated switches 1 arranged in a keyboard matrix of rows and columns with these switches sufficiently proximate to one another to allow a single finger of the user to activate a plurality of switches in a single stroke. Timing means 2 is triggerable by the switches 1. The activation of any switch will trigger timing means 2 which upon being triggered begins timing for a time period t. Timing means 2 can be retriggered by any switch prior to the expiration of t and will then continue timing t seconds beyond the last retriggering. The duration of t is, in the preferred embodiment, user-adjustable. A retriggerable time offers the advantage of minimizing the wait between the last switch activated and the onset of the acoustic event called for by either single or multiple switch activations. Accordingly the "wait" never exceeds t seconds. The keyboard system of the instant invention includes a decoding means 3 which is responsive to the switches 1 and which is controlled by the timing means 2 to read and register, upon the expiration of the time period t, all switches presently activated at the point of the time period expiration. Timing means 2 is an important element of the system and is made necessary by the fact that human users intending to simultaneously activate a number of switches will rarely, if ever, effect a truly simultaneous activation. Timing means 2 provides a time window starting at the activation of the first switch and ending t seconds later during which the user may sequentially activate switches which he intends to activate and believes that he is activating smultaneously. At the end of t seconds the decoding means 3 reads and registers all of the switches presently activated. The decoding means 3 is configured to detect and distinguish between a first language and a language of distinct switch activation patterns.

The first language is characterized by the reading and registration of a switch activation pattern where not more than one switch in any particular column is activated and less than all of the switches in any particular row are activated. The first language is further characterized by the reading and registration of a switch activation pattern where at least one switch in each column is activated and all of the switches in one row are activated. In the preferred embodiment of the instant invention the keyboard is configured in six columns and twenty six rows of switches so that the switch positions are analogous to finger positions on a guitar fretboard. The first language can be seen by those familiar with guitar playing to comprise normal traditional guitar fingering. This includes barre which, in the keyboard aforementioned, would be accomplished by activating all of the switches in one row.

The second language is characterized by the reading and registration of a switch activation pattern where at least two switches are activated in at least one column and the number of switches activated in any row is less than the total number of switches contained in that particular row. This second language of switch patterns does not correspond to normal traditional guitar fingering and accordingly can be used to produce a number of "special effects" such as pre-set chords.

The decoding means 3 can be implemented in a number of different ways including the use of logic gates, diodes, or a software routine. The words "reading and registering" when used in the context of the aforementioned decoder simply mean the acquiring of information relating to the identity of activated switches and storing this information long enough so that it can be passed on to the processing means 4. In the processing means 4 the switch pattern data is translated into musical note information which is then used for a variety of purposes including the generation of appropriate electronic tones corresponding to the notes and also for the generation of alphanumeric representations of these notes. In the preferred embodiment processing means 4 is a digital microprocessor which can be programmed by the user. When the decoding means 3 reads and registers a first language switch pattern the processing means 4 converts these first language patterns into musical note information which corresponds to the notes which would be produced on a traditional guitar were the same fingering used. In the case of the reading and registration of a second language switch pattern, the processor can do an almost unlimited number of things, the most common and useful of which would probably be the generation of pre-stored musical note information corresponding to chords. This would allow an experienced user to instantly generate complex chords merely by using one finger to activate two switches in a single column. The usefulness of the two language system should become immediately apparent. Second language switch activation patterns can also be used to generate pre-stored melodies and anything else which is capable of residing in digital memory.

Electronic tone generation means 5 is connected to the processing means 4 and is responsive to the processor's output of musical note information. The tone generation means 5 is, in the preferred embodiment, a digitally controlled electronic synthesizer which receives its input from the processor. A video character generator 6 is also connected to the processing means 4 and is responsive to its output. The character generator 6 is, in the preferred embodiment, used to generate alphanumeric and/or graphic representations in musical tabulature form of the musical note information which is present at the output of the processor. A display means 7 is connected to the character generator for visually displaying the aforementioned graphics and characters. The display can be a CRT type or any number of suitable electroluminescent or reflective display panels capable of sufficient resolution. Additionally, the character generator 6 can be configured to generate patterns and colors corresponding to musical note information to produce a kaleidoscopic and other visually interesting "special effects".

Learning is especially enhanced by a feature of the instant invention which includes a plurality of electroluminescent display devices 8 which appear in the drawing as circles in the center of the switches. These electro-luminescent display devices are typically light emitting diodes (L.E.D.s) which are controlled by the processor output through interface 22 which contains the necessary decoding and driver circuitry. Each L.E.D. is associated with each of the switches on a one-to-one basis and is located in close proximity to its associated switch. With proper programming these electro-luminescent devices can be used for prompting the user. A typical application of this feature would be to teach chord fingering. Even a beginning user could learn the simple second language short-hand pattern for generating a pre-set chord. The musical note information generated by the processing means 4 would correspond to that chord and could then be used, with the proper interface, to illuminate the L.E.D.s on the particular switches which the user would have to press to generate the same chord using the first language or long-hand switch pattern. At the same time the display 7 could be used to graphically illustrate the musical makeup of the chord in tabulature form.

In the preferred guitar-like embodiment of the instant invention the envelope signal generation source 9 has an input 10 for signals from a natural vibration source. In the case of the guitar the vibrations would be the vibrations of strings 11. An electric pickup 12 would detect the vibrations of the strings 11 and convert them into voltage signals. In alternative embodiments the natural vibration source could be a human voice, a precussion instrument, or anything else which falls into the general category of having naturally vibrating elements. In this context the word "naturally" is used to distinguish electronically synthesized envelope signals from those which derive from actual physical movement.

An analogue switch means 13 is provided and is typically a voltage controlled amplifier. The analogue switch has, as a signal input, the tone signals generated by tone generation means 5 and has, as its modulating input, envelope signals from the envelope signal generation source 9. The output of the analogue switch means would then be electronic tones from 5 modulated in amplitude by the envelope signals from 9. As an additional feature the envelope signals from 9 can be sampled by the processor 4 through interface 21 (typically a suitable analogue to digital converter) and used to modulate the video display via the character generator 6. A typical application would be to modulate the intensity and/or the color the graphic display in accordance with the intensity of the string vibration. More particularly individual notes within a displayed chord could be intensified as the appropriate strings are activated by the user. The beginner would associate musical tabulature with certain physical actions such as fingering and strumming and should therefore quickly learn to read music.

In alternative embodiments the envelope signal generation source 9 can employ electronically synthesized signals which can be triggered externally either by strumming a string or by any other means capable of producing an electrical signal for triggering the synthetic envelope signal. Additionally, the envelope signal generation source can employ an automatic series of electronically synthesized signals similar to those produced by commonly available automatic rythym synthesizers. In FIG. 1 a mixer amplifier 14 and a speaker 15 are used to aurally reproducing the modulating tones which appear at the output of the analogue switch means 13. Although the preferred embodiment of the instant invention is the aforementioned guitar-like instrument, the invention is capable of embodiment in many other types of instruments. While stringed instruments are especially well suited, the instant invention could be used in a piano-like instrument.

The keyboard system of the instant invention and more particularly the two distinct but compatible languages of switch activation patterns offer substantial benefits to beginners and experts alike. In the hands of a skillful musician a guitar-like instrument embodying the instant invention could be used to produce, in real time, music which was previously available only on carefully produced, dubbed, and mixed studio recordings. By fully exploiting the second language capabilities of the instrument a user could play, in real-time, passages which simply could not be similarly produced on a conventional guitar.

What is claimed is:

1. A multiple-language electronic keyboard system for generating and modifying musical note information comprising:

a plurality of manually activated switches arranged in a keyboard matrix of rows and columns with said switches sufficiently proximate to one another to allow a single finger of a user to activate a plurality of switches in a single stroke;

retriggerable timing means triggerable by said switches which upon being triggered by the activation of any switch begins timing for a time period t, during which period additional switch activations will retrigger said timing means and extend the time period for t seconds beyond the instant of the last retriggering;

decoding means responsive to said switches, said decoding means controlled by said timing means to read and register, upon the expiration of time period t, all switches presently activated at the point of said expiration;

said decoding means configured to detect and distinguish between a first language and a second language of distinct switch activation patterns;

said first language characterized by the reading and registration of a switch activation pattern where one and only one switch in any particular column is activated and less than all of the switches in any particular row are activated;

said first language further characterized by the reading and registration of a switch activation pattern where at least one switch in each column is activated and all of the switches in one row are activated;

said second language characterized by the reading and registration of a switch activation pattern where at least two switches are activated in at least one column and the number of switches activated in any row is less than the total number of switches contained in that particular row; and processing means responsive to said decoding means for generating musical note information at the output of said processor means which depends on the location of each activated switch and the language detected by said decoder.

2. The device of claim 1 further comprising manually activated means for adjusting the duration of time period t.

3. The device of claim 1 further comprising electronic tone generation means responsive to said processor output for generating tones corresponding to said musical note information.

4. The device of claim 1 further comprising character generation means responsive to said processor output for generating graphic characters corresponding to said musical note information.

5. The device of claim 1 further comprising a plurality of electro-luminescent display devices controlled by said processor output; each of said devices associated with each of said switches on a one to one basis and each device being located in close proximity to its associated switch.

6. The device of claim 4 further comprising display means for visually displaying said graphic characters for user viewing.

7. The device of claim 4 further comprising said character generation means generating a pictorial display of the keyboard and the fingering positions corresponding to said musical note information.

8. The device of claim 4 further comprising an envelope signal generation source having means for detecting the amplitude of vibrations from a natural vibration source.

9. The device of claim 8 further comprising means for modulating said characters by envelope signals from said envelope signal generation source.

10. The device of claim 3 further comprising an envelope signal generation source in which said envelope signal is an automatically repeating series of electronically synthesized signals.

11. The device of claim 3 further comprising an envelope signal generation source where said envelope signal is a manually triggerable electronically synthesized signal.

12. The device of claim 3 further comprising an envelope signal source and analog switch means, said analog switch means having as a signal input, the tone signals generated by said tone generator, and having as a modulating input, envelope signals from said envelope signal source to provide at the output of said analog switch means tones modulated by said envelope signals.

13. The device of claim 12 in which said envelope signal source is vibrating strings and said switches are positionally configured in six columns and 26 rows of switches, said analogue switch means is a voltage controlled amplifier and said modulating input is a voltage signal proportional to string vibration amplitude and said signal input is a synthetically generated tone.

14. The device of claim 12 further comprising means connected to the output of said analog switch means for amplifying and aurally reproducing said modulated tones.

* * * * *